US006409476B2

(12) United States Patent
Mills

(10) Patent No.: US 6,409,476 B2
(45) **Date of Patent: *Jun. 25, 2002**

(54) PUMPJACK DYNAMOMETER AND METHOD

(75) Inventor: Manuel D. Mills, Midland, TX (US)

(73) Assignee: DJAX Corporation, Midland, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/747,831

(22) Filed: Dec. 22, 2000

Related U.S. Application Data

(63) Continuation-in-part of application No. 09/369,792, filed on Aug. 6, 1999, now Pat. No. 6,176,682.

(51) Int. Cl.[7] ..... F04B 49/00
(52) U.S. Cl. ..... 417/18; 417/12
(58) Field of Search ..... 417/12, 18; 73/152.61; 318/771; 60/398; 165/53

(56) References Cited

U.S. PATENT DOCUMENTS 4,466,301 A * 8/1984 Hill ..... 74/41
4,501,119 A * 2/1985 Santon ..... 60/398
4,644,785 A * 2/1987 Doyle ..... 73/152.61
4,691,155 A * 9/1987 Taylor et al. ..... 318/771
RE33,690 E * 9/1991 Adams et al. ..... 165/53
5,222,867 A * 6/1993 Walker et al. ..... 417/12
5,230,607 A * 7/1993 Mann ..... 417/12
5,362,206 A * 11/1994 Westerman et al. ..... 417/12
5,425,623 A * 6/1995 London et al. ..... 417/18
5,678,981 A * 10/1997 Dunham ..... 417/18
6,176,682 B1 * 1/2001 Mills ..... 417/18

* cited by examiner

*Primary Examiner*—Teresa Walberg
*Assistant Examiner*—Leonid M Fastovsky
(74) *Attorney, Agent, or Firm*—Loren G. Helmreich; Browning Bushman P.C.

(57) ABSTRACT

A dynamometer readout (42, 46) and method is disclosed for obtaining dynamometer information (110) related to pumpjacks (10). For this purpose, a change of pivotal direction of the walking beam (18) may be detected by processor (82) utilizing an encoder component (60) with spaced slots (64) therein and light signal devices (68, 70, 72, 74) positioned to have a spacing different from that of the spacing of the slots (64). Software techniques filter out effects of stray mechanical vibrations. An infrared transceiver (46, 50, 100) of a preferred embodiment includes a radio frequency carrier generator (90) and modulator (88) that produces an infrared signal receivable by a low cost consumer radio receiver. The radio frequency modulation technique for infrared signals (96) and related filtering (98, 102, 104) condition formatted infrared signals for utilization in daylight and through a car window for drive-by downloading of data to second computer (108). A sensor (163) may be substituted for the encoder. A sensor (163) may include a moveable light interrupter, such as a ball (160) or a bubble (260), moveably disposed within the sensor. The sensor may also provide one or more apertures (180) for transmitting light through the apertures.

23 Claims, 5 Drawing Sheets

PUMPJACK DYNAMOMETER AND METHOD

Continuation-in-part of application Ser. No. 09/369,792, filed on Aug. 6, 1999, now U.S. Pat. No. 6,176,682.

1. FIELD OF THE INVENTION

The present invention generally relates to pumpjack dynamometers and, more particularly, to apparatus and methods for producing and transmitting dynamometer card information.

2. BACKGROUND OF THE INVENTION

Dynamometers are commonly utilized in the oil field to monitor the operation of pumpjacks used to pump oil to the surface. The dynamometer card provides information related to pumping conditions as described in detail in subsequently listed patents. For instance, a typical use of such information involves determining when a well has reached what is known as a "pump-off" condition wherein the wellbore does not receive enough oil to fill the downhole pump during the entire pump stroke. Changes in the dynamometer card readings over time may be used to provide this information. It may be desirable to temporarily stop operating the pump until the pump off condition has been obviated by continued flow from the formation into the wellbore while the pump is shut down. Pump-off control techniques are known to improve field development efficiency and reduce maintenance costs.

Changes in the dynamometer card readings over time is one of the more important uses of dynamometer card information. Consistency over time in the way measurements are taken is important for this use of dynamometer card information. Consistency requires that calibrations remain constant and do not change over time, as has been a problem with many prior art devices. It would be desirable to have a sensor that does not require time consuming initial calibration procedures, that automatically calibrates itself, and that continuously re-calibrates itself so that one can be assured that changes in dynamometer card information over time are due to changes in the well rather than changes in the calibrations.

Various sensors are provided in the prior art for determining the position of the walking beam of the pumpjack. Potentiometers, reed switches, and other types of switches have been used in the past in order to supply signals indicative of the position of the walking beam. The problem with such position sensing devices is that they are usually subject to wear, require careful initial calibration, require maintenance including regular re-calibrations, and may not always provide accurate or reliable information. Hydrogen sulfide gas is often present in the vicinity of the pump jack, and that gas adversely affects the reliability of much of this sensing equipment. Well personnel working on the pumpjack may inadvertently loosen or change components in such a way that calibrations are affected. Prior art equipment for sensing the position of a walking beam is frequently mounted on the walking beam at a location where it is highly susceptible to weather conditions such as variable temperature, and may have reduced reliability due to temperature drift errors. Minor irregularities or mechanical jitters in movement of the walking beam may also cause spurious or repeatable errors.

As the dynamometer data is produced, various means are used to collect and use the data, some of which require expensive sensors, some of which may be less reliable over time, and some of which may require significant maintenance for calibration requirements. It would be desirable to provide methods for sampling dynamometer card information that may be used to monitor well conditions over time at less cost with improved reliability.

Once data is collected, radio transmitters have been used in the past to transmit the data to another location. However in some areas, use of radio transmitters is not allowed. Where radio transmitters are allowed, it is often difficult to obtain additional channels for transmission. As well, FCC rules must be followed and may require radio transmitters to be installed according to certain specifications that may limit their usefulness for some purposes. Infrared transmitters have limited usefulness in sunlight due to ambient infrared noise that results in a short transmission distance if operation is possible at all. As well, infrared transmitters have limited selectivity and would have problems for use with closely spaced wells where multiple transmissions may occur.

The following patents discuss the aforementioned background and problems in some depth along with previous solutions to the many problems encountered in this area:

U.S. Pat. No. 4,363,605, issued Dec. 14, 1982, to Manuel D. Mills, discloses an apparatus for generating an electrical signal which is proportional to the tension in a bridle that supports a string of sucker rod associated with a pumpjack unit.

U.S. Pat. No. 5,458,466, issued Oct. 17, 1995, to Manuel D. Mills, discloses an apparatus and method for minimizing fluid pounding in a pumpjack by dictating the length of the run cycles of the pumpjack.

U.S. Pat. No. 4,631,954, issued Dec. 30, 1986, to Manuel D. Mills, discloses an improved pump control having a device for measuring relative movement between structural components of a pumpjack, and converting the movement into a signal which varies according to the magnitude of the movement.

U.S. Pat. No. 4,873,635, issued Oct. 10, 1989, to Manuel D. Mills, discloses a pump off control device for controlling a pumpjack unit. The device measures the length of time required for the pump to down-stroke successive numbers of times. When the time differential reaches a predetermined value, the well is shut in for a time interval.

U.S. Pat. No. 4,492,029, issued Jan. 8, 1985, to Tanaka et al., discloses an inclinometer comprising a sector weight pivotally supported on a main body, which may become inclined. The weight is relatively rotatable with respect to the main body and constantly hanging vertically due to gravity regardless of an inclination of the main body. A code part and a detecting part produces a detection output based on the predetermined code according to the inclination of the angle of the body.

U.S. Pat. No. 4,584,778, issued Apr. 19, 1986, to Komasaku et al., discloses an angle change indicator comprising a pair of opposing magnets, a sector-shaped pendulum made of an electro-conductive non-magnetic material and pivotal past a spacing between the opposing magnets, and a pair of photo sensors disposed on both side edges of the pendulum.

U.S. Pat. No. 4,467,527, issued Aug. 28, 1984, to North et al. discloses a digital level that includes a digital display for displaying the angle of inclination between a straight edge of a digital level and a desired reference plane. An alarm is also included to indicate whenever the digital level is held parallel to a desired reference plane.

U.S. Pat. No. 4,716,534, issued Dec. 29, 1987, to Baucom et al., discloses an angle finder with a rotatably mounted disc on which is mounted a weight. The disc has markings that represent two degrees of arc. Three photo detectors sense the movement of the markings and a microprocessor determines angular alignment of the reference surface.

U.S. Pat. No. 4,798,087, issued Jan. 17, 1989, to Takeda et al., discloses an inclination detector of a generally fan shaped detector having a plurality of slits formed therein concentrically at intervals, and a light emitting element and a light sensitive element constituting a photo coupler disposed on opposite sides of the displacement detection plate.

U.S. Pat. No. 4,811,492, issued Mar. 14, 1989, to Kakuta et al., discloses a cant angle sensor assembly that includes a pendulum pivoted on a supporting system adapted to be mounted on an object whose cant angle is to be sensed for swinging movement in a direction of the tilt of the object. A moveable electrode is provided on the pendulum and has a first and second movable electrode plate, and a first stationary electrode plate is fixedly mounted on the supporting system in an opposed relation.

U.S. Pat. No. 4,922,620, issued May 8, 1990, to E. Terragni, discloses a device for determining the inclination of a plane with respect to a theoretical horizontal plane wherein an inclination detector element is rotatably associated with a box like body. Light detectors determine the position of the detector element with respect to the base plane based on coded slits therein.

U.S. Pat. No. 4,942,668, issued Jul. 24, 1990, to R. C. Franklin, discloses a digital inclinometer for detecting the angular orientation of a structure that includes a rotatable encoding disk on which is mounted a horizontal tilt sensor. The inclinometer electronically measures, by angular indices on the encoding disk, the difference between the angular orientation of the device and a horizontal orientation.

U.S. Pat. No. 4,606,133, issued Aug. 19, 1986, to F. J. Mills, discloses an inclinometer for producing high-resolution signals of inclination relative to various references. High-resolution data signals are produced through the use of a digital encoding wheel, which is suspended in equilibrium in a fluid to substantially eliminate frictional forces. A microprocessor or state logic machine is used to analyze and process the data to provide various displays of inclination including an audible output.

U.S. Pat. No. 3,951,209, issued Apr. 20, 1976, to S. G. Gibbs, discloses a method for monitoring a rod pumped well and determining when the well has pumped off. The method uses a dynamometer to monitor the power input to the rod string and senses when the power input decreases to determine when the well pumps off.

U.S. Pat. No. 4,143,546, issued Mar. 13, 1979, to R. P. Wiener, discloses a device to determine the work done by a sucker rod pump using a pendulum potentiometer mounted on the walking beam of the pump and a load sensing pin located at the lower end of the wire line which is suspended from the horsehead. Meters mounted in a portable reading instrument show the maximum rod pull, the minimum rod pull, the stroke of the pump, and the area of the force-versus-stroke diagram. A display of the shape of the force-versus-stroke diagram may be given through the use of an X-Y plotter.

U.S. Pat. No. 4,483,188, issued Nov. 20, 1984, to McTamaney et al., discloses an apparatus for recording and subsequent playback of selected dynagraphs for well employing sucker rod pumping units to determine well faults which cause well shut down. Calibration data from well monitoring equipment is stored in a first endless tape type of memory during calibration of the well, and operation data from the monitoring equipment is stored in a second endless tape.

U.S. Pat. No. 4,509,901, issued Apr. 9, 1985, to McTamaney et al., discloses a method for detecting problems in sucker rod well pumps and for determining which type of problem occurs. A first transducer provides a signal representative of the load on a sucker rod string and a second transducer provides a signal representative of the sucker rod position. The load signal and position signal are used to generate a dynagraph of rod load versus rod position with the pump working normally.

U.S. Pat. No. 4,551,730, issued Nov. 5, 1985, to McTamaney et al., discloses a method for entering control points relative to a dynagraph of a well pumping unit using the position of a beam and pen holder of an X-Y plotter.

U.S. Pat. No. 4,561,299, issued Dec. 31, 1985, to Orlando et al., discloses an apparatus for detecting changes in inclination used to determine the position of the sucker rod of a sucker rod pump and includes a magnetic field sensor such as a linear output transducer to provide a linear output signal and a cantilever spring having a counterweight and magnet on its free end disposed adjacent to the linear transducer.

U.S. Pat. No. 4,583,915, issued Apr. 22, 1986, to Montgomery et al., discloses a pump off controller that checks for pump off by calculating the area inside of a figure whose boundaries are the minimum load.

U.S. Pat. No. 4,594,665, issued Jun. 10, 1986, to Chandra et al., discloses an apparatus for detecting fluid found in a sucker rod oil well, using values of sucker rod position and sucker rod load to calculate a reference position and a selected load value.

U.S. Pat. No. 4,817,049, issued Mar. 28, 1989, to Bates et al., discloses a data logging device with a data memory unit and a transducer interface unit.

U.S. Pat. No. 4,973,226, issued Nov. 27, 1990, to F. E. McKee, discloses a method of maintaining a substantially constant amount of filling of a liquid well pump actuated by a polished rod which is reciprocated by a prime mover.

U.S. Pat. No. 5,064,349, issued Nov. 12, 1991, to Turner et al., discloses a method of monitoring and controlling a pumped well having a rod string extending from a pumping unit.

U.S. Pat. No. 5,167,490, issued Dec. 1, 1982, to McKee et al., discloses a method of calibrating a well pump off controller for determining the average load during a pumping stroke.

U.S. Pat. No. 5,182,946, issued Feb. 2, 1993, to Boughner et al., discloses a device for use on a well pumping unit that provides for real time measurement and recording of acceleration of a polished rod resulting from the oscillating linear motion induced by the rotating motion of the pumping unit crank.

U.S. Pat. No. 5,224,834, issued Jul. 6, 1993, to Westerman et al., discloses an apparatus for controlling the operation of a rod pumped well.

U.S. Pat. No. 54,291,777, issued Mar. 8, 1994, to Chang et al., discloses a system for monitoring performance of a pumping unit of an oil well that includes a first sensor for measuring the inclination angle of a beam forming part of the pumping unit, a second sensor for measuring the load on the beam, and a third sensor for measuring the load on an electrical motor used in conjunction with the pumping unit.

U.S. Pat. No. 5,406,482, issued Apr. 11, 1995, to McCoy et al., discloses a device to produce a position trace for a pumpjack with stroke markers to indicate position of the rod during its cyclical operation using an accelerometer.

U.S. Pat. No. 4,541,274, issued Sep. 17, 1985, to J. C. Purcupile, discloses a device wherein pulses produced by a pulse generator coupled to the output shaft of an electric motor are counted by a computer to locate the polish rod at a series of positions during each reciprocation.

Although the above-listed patents address problems relating to position indicating sensors, they do not disclose highly reliable techniques for automatic calibration and re-calibration of such devices to thereby substantially eliminate calibration errors that may otherwise distort dynamometer cards taken at different times using prior art devices. The present device also works to reduce or eliminate errors caused by mechanical jitter or variations in the walking beam movement through the pumping cycle. As well, the present invention provides apparatus and techniques to improve data collection techniques. Moreover, the present invention provides reduced manufacturing and operating costs.

Consequently, there remains a need for a lower cost, readily available, easily manufactured, quickly assembled, lower maintenance apparatus and methods for providing data used for producing dynamometer cards. Those skilled in the art have long sought and will appreciate the present invention that addresses these and other problems.

3. SUMMARY OF INVENTION

In accordance with the present invention, a dynamometer readout apparatus is provided for a pumpjack. The pumpjack has a walking beam which is pivotally moveable in a first pivotal direction and in an opposite second pivotal direction. The walking beam changes pivotal direction twice during each pumping cycle for a pumping well. An encoder component may be pivotally secured to the walking beam and has a plurality of spaced apart slots disposed therein. The encoder component may be equipped with a biasing member for biasing the encoder component to remain at a substantially constant reference orientation as compared to the walking beam. Aligned on opposite sides of the encoder component may be first and second light emitters with corresponding first and second light detectors which are fixed in position to the walking beam for angular movement in the first and second pivotal directions with respect to the reference orientation of the encoder component. These first and second light emitters and corresponding light detectors are mounted with a spacing different than the spaced apart slots of the encoder component to thereby produce a plurality of electrical signals. The electrical signals include a first sequence of signals for movement of the walking beam in the first pivotal direction and a second sequence of signals for movement of the walking beam in the second pivotal direction.

The dynamometer apparatus further comprises a load sensor, which may be mounted to detect loading corresponding to the pumping cycle for producing an electrical load signal. A processor is electrically connected to the first and second light detectors to receive the first sequence of signals and the second sequence of signals. This processor may be programmed to analyze the first and second sequences of signals to detect a change in direction from the first pivotal direction of the walking beam to the second pivotal direction of the walking beam. The processor may also be preferably programmed to distinguish any mechanical jitter that produces a temporary change from the first to second sequences of signals. The processor may time from an initial change of the first to second sequences of signals and continues to monitor to verify that the second sequence of signals is consistent. This process verifies that a change in direction from the first to the second pivotal direction of the walking beam has occurred. The processor may also be programmed to time the pumping cycle and set a window period wherein a change from first to the second pivotal direction of the walking beam is projected to occur. The processor uses the change in direction to control the initiation of sampling of the electrical load signal for producing dynamometer readout of load with respect to the pumping cycle.

The processor may provide a sampling rate that is variable for each pumping cycle, depending on the duration of the pumping cycle. In doing so, the processor may obtain a first time duration for the first pumping cycle and a predetermined number of samples. The processor uses the first time duration and predetermined number of samples to determine a sample rate for sampling the electrical load signal during the second pumping cycle subsequent to the first pumping cycle. The processor thus may do the same to each subsequent pumping cycle. The processor may therefore provide a first constant sampling rate during the first pumping cycle and a second constant sampling rate during the second pumping cycle, etc. The sampling rate may also vary during each pumping cycle according to a table or as desired.

For transmission purposes, the sampled data may be transmitted at a fixed rate that is approximately half of a time duration required for a fast pumping unit to complete the pumping cycle. By spacing each sample of sampled data throughout a pumping cycle transmission signal with a data separation indicator therebetween, each sample is separately distinguishable as is desirable for transmission accuracy purposes.

The processor transmits data at a constant rate using a data format with an index word for beginning each new dynamometer card. Data is transmitted from a light-emitting transmitter on the dynamometer readout device.

The dynamometer readout may also comprise a radio frequency carrier generator and a radio modulator for receiving the sampled data from the processor and for modulating the radio frequency carrier generator to produce a modulated radio frequency carrier signal. A light emitting element may be used as a transmitter to produce a light signal in response to the modulated radio frequency carrier signal. For receipt of the light signal, a light filter may be used for filtering the light signal and another light detector receives the light signal. The light detector produces the modulated signal and a radio frequency detector demodulates the modulated signal to produce the sampled signal. A second computer may receive and analyze the sampled signal. This second computer may be operable for producing a dynamometer card from the sampled signal. The dynamometer receiver preferably uses a narrow band filter for filtering the output of the light detector and a high gain amplifier for amplifying an output of the narrow band filter.

Other varieties of sensors may be substituted for the slotted encoder component. A dynamometer readout may include a sensor having one or more apertures through which light is projected from a light emitter to a light detector. A moveable object that may distort or block the light, such as a solid object or a gas or fluid bubble, may be provided within the sensor. The moveable object may be positioned to move along a path that intersects the light path through the aperture. The moveable object may act as a light interrupter to interrupt the light received by various sensors as the interrupter moves in response to walking beam movement. Such embodiments may include two or more pairs of light emitters and detectors.

It is an object of the present invention to provide an improved dynamometer readout device and method.

It is another object of the present invention to provide a highly reliable device whereby long term calibration errors are at least substantially eliminated so that the dynamometer card changes over time are indicative of changes in the well rather than changes in calibration.

It is yet another object of the present invention to provide an improved data sampling method.

It is yet another object to provide an improved data transmission device and method.

These and additional objects, features, and advantages of the present invention will be apparent to those skilled in the art especially after review of the technical drawings, the descriptions and discussions given herein, as well as the appended claims. It will be understood that listed objects, features, and advantages of the present invention are provided solely as an aid for more quickly understanding aspects of the invention and are not intended to be limiting of the invention in any way.

4. BRIEF DESCRIPTION OF THE DRAWINGS

While the present invention will be described in connection with presently preferred embodiments such as those described in the above-designated figures, it will be understood that it is not intended to limit the invention to those embodiments. On the contrary, it is intended to cover all alternatives, modifications, and equivalents included within the spirit of the invention and as defined in the appended claims.

5. DETAILED DESCRIPTION OF PREFERRED EMBODIMENTS

Figure 1:
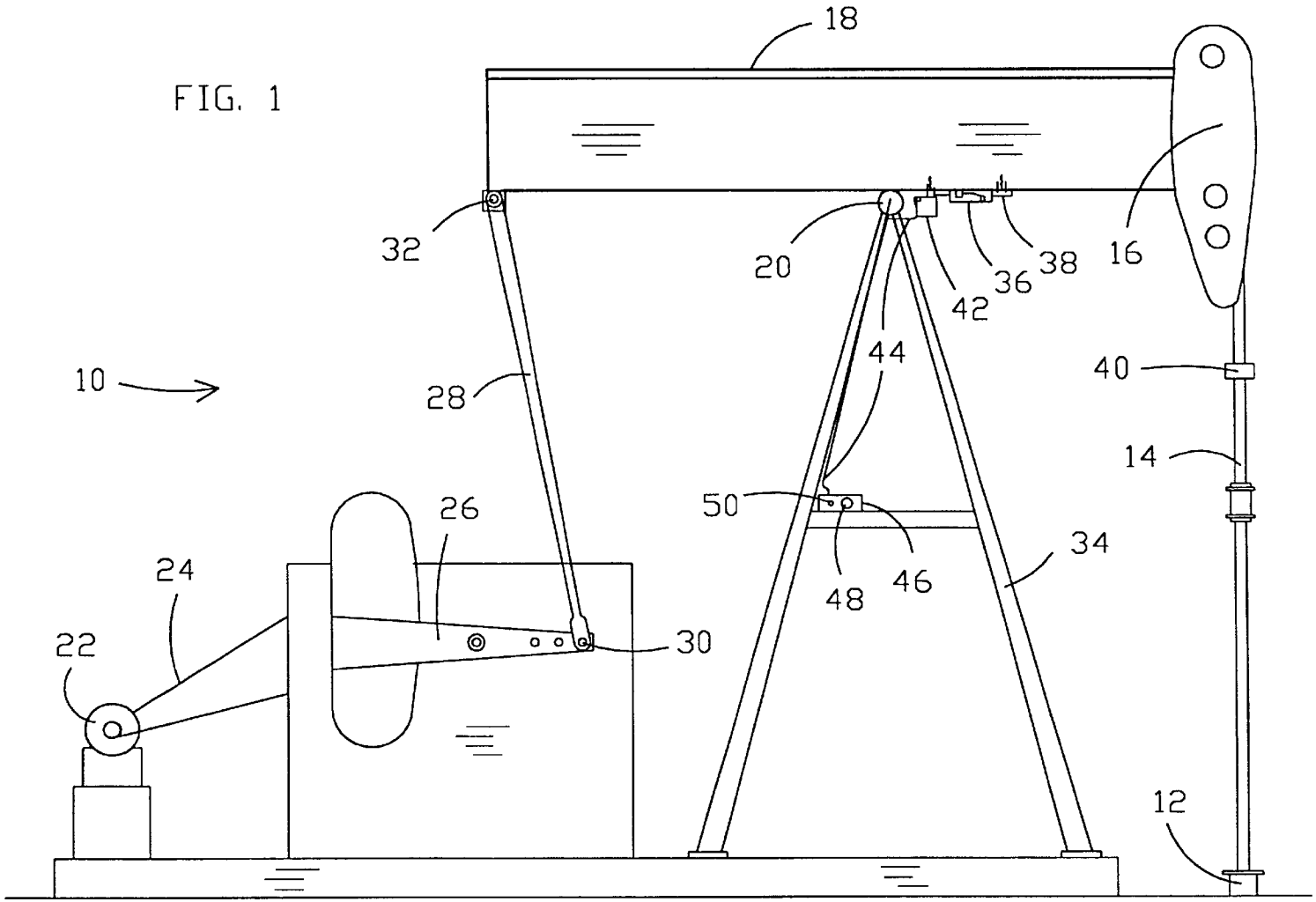
FIG. 1 is a diagrammatical side elevational view of a pumpjack unit having apparatus made in accordance with the present invention associated therewith.

Referring now to the drawings, and more particularly to FIG. 1, a pumpjack unit 10 is shown in operative relationship respective to a wellhead 12. A downhole pump (not shown) is activated by reciprocal movement of sucker rod string (not shown) and polished rod 14 that is suspended from horse head 16. Horse head 16 is affixed to walking beam 18, which is a rigid beam that extends on either side of pivot connection 20. Walking beam 18 is reciprocated by a prime mover 22, which may typically comprise an electric motor. Prime mover 22 drives walking beam 18 through a drive system which may typically comprise elements such as drive belt 24, crank arm 26, drive arm 28 that is pivotally connected to walking beam 18 and crank arm 26 with pin connections 30 and 32. Walking beam 18 is pivotally supported by a suitable frame 34 such that walking beam pivots in two different directions, moving sucker rod string and polished rod 14 upwardly and downwardly during each pump stroke.

A load transducer of some desired type, such as strain gauge 36, is mounted with clamps 38 or other means to a convenient protected position on walking beam 18. The purpose of strain gauge 36 is to measure the load changes on the walking beam as it is driven by prime mover 22 during the pumping cycle. The load changes are proportional to the load changes on sucker rod string as indicated at polished rod 14 utilized at the surface to effect a seal. The load transducer is of the type that produces an electrical signal in response to changes in loading on walking beam 18. This may be an electrical bridge type transducer or the like. It is to be understood that other types of load transducers may be employed and at other locations. For instance, transducers may include a polished rod load cell 40 or other transducers secured to the horse head, cables, polished rod, and the like. To provide dynamometer information, it is therefore necessary to obtain loading information during each pumping cycle.

Figure 2:
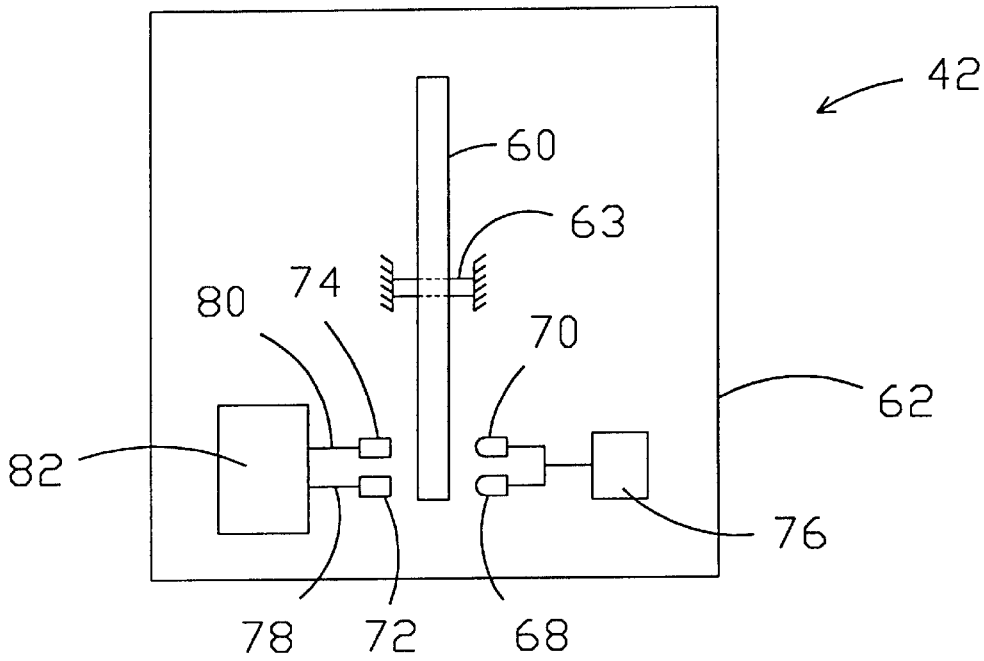
FIG. 2 is a diagrammatical view of a pumping cycle sensor for a pumpjack in accord with the present invention.

Micro-controller 42 is mounted for movement with walking beam 18 and is shown diagrammatically in FIG. 2. Micro-controller 42 receives the data from load sensor 36 and from a preferably internally mounted positioning sensor. Micro-controller 42 and preferred components are discussed in more detail hereinafter.

Cable 44 from micro-controller 42 is preferably a four conductor type of cable and connects to infrared transceiver 46. Transceiver 46 may include, if desired, a twelve volt power supply plug 48 as an alternative, backup, or main means to power the dynamometer readout of the present invention. An infrared transceiver unit 50 is also preferably used as discussed in more detail subsequently.

Micro-controller 42 also preferably includes a means for monitoring the oscillatory movement involved in a reciprocal pumping cycle. During a pumping cycle, walking beam 18 rotates, tilts, or pivots in one direction and then in the opposite direction during which time the sucker rod, polished rod 14, and the like go upwardly and downwardly. Generally, a dynamometer card is a graph that will show the upper and lower points of the pumping cycle on either end thereof. The beginning of a pump stroke may be arbitrarily defined as either the top or the bottom of the pumping cycle. The micro-controller times, preferably to the millisecond, the elapsed time between the beginning of one stroke and the beginning of the next. Preferred points of interest are the top and bottom of the stroke. These points occur at the end of the pivotal direction of walking beam 18 and at the ends of movement of polished rod 14. For this reason, most pump cycle sensors have to be calibrated so as to be exactly in the desired position. It is difficult to obtain and maintain the necessary accuracy to provide accurate timing to the millisecond at the top and bottom of the stroke as desired with prior art pump cycle sensors.

Figure 3:
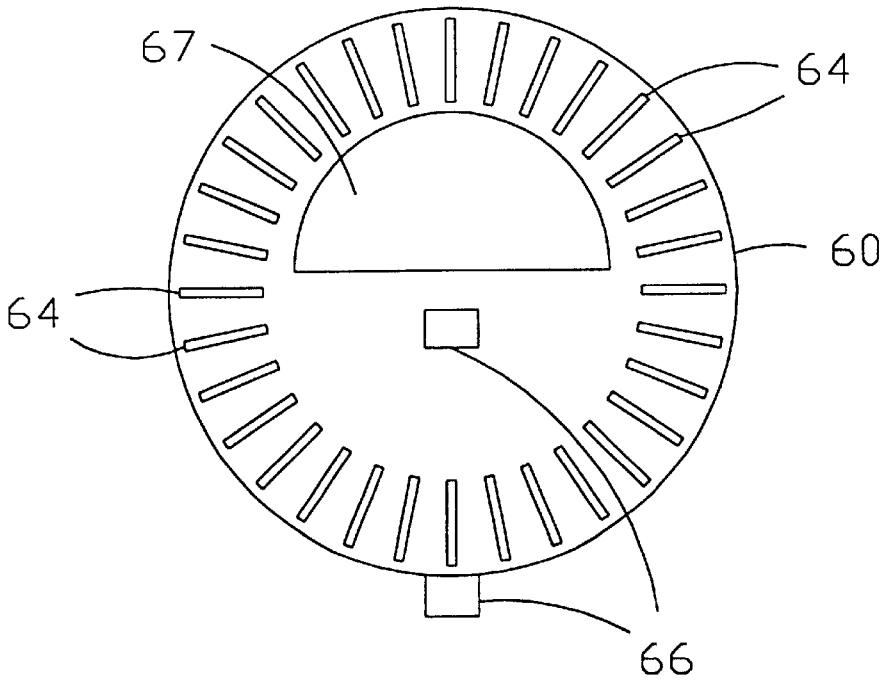
FIG. 3 is an elevational view of a slotted component for use with the pumping cycle sensor of FIG. 2.

One presently preferred embodiment of the present invention uses a sensor that does not require calibrations, but rather calibrates itself in a preferred method of operation of the sensor, and preferably does so during each cycle so as remain extremely accurate. Referring now to FIG. 2 and FIG. 3, there is shown a encoder component 60 mounted for rotation within micro-controller housing 62. Micro-controller housing 62 is preferably secured to walking beam 18 at a convenient position. Encoder component 60 is mounted on bearings or other suitable means as indicated at 63 to allow free rotation of encoder component 60. Encoder component 60 should be free to rotate easily so as to detect changes in pivotal direction of movement of walking beam 18. While encoder component 60 is shown in the form of a wheel, it could also take the shape of a fan, wedge, or other shape so long as it functions as discussed subsequently. Slots 64 are preferably identical and are preferably arranged around the circumference of encoder component 60 at an even spacing. With the wheel construction as shown, not all slots will be used as walking beam 18 is limited in its tilt, and so some slots could be left out as desired. However, with the wheel construction as shown, a wide range of different pivotal amplitudes of oscillation of walking beam 18 can be accommodated. Which slots will be used and which slots will not be used actually depends on the location of subsequently discussed components and the pivotal amplitude of oscillation of the walking beam.

Preferably, several hundred identical slots 64 are provided at even spaces around encoder component 60, and a convenient number would be 360 slots with a one-degree spacing. As will be seen subsequently, this spacing provides one-quarter degree accuracy although it will be understood that the accuracy could be made significantly greater by providing more slots. The working portion of encoder component 60 could be made larger to accommodate more slots, if desired, and non-working portions left off. Other additional components of the type discussed subsequently could also be used to improve accuracy, if desired.

To detect a change in direction, encoder component 60 is preferably biased to remain in a constant position while walking beam 18 moves pivotally. This may be accomplished in different ways. For instance, weights 66 may be used in a position below the center of rotation so as to bias encoder component 60 in a fixed position. An open region 67 may be used for the same purpose. The shape of encoder component 60 in a fan or wedge would result in a weight biased to one position by gravity. Preferably, encoder component 60 has a large thickness or weight to provide a resting inertia that will overcome small frictional forces that might cause gripping of encoder component 60 at end points of the stroke. Thus, encoder component 60 is set up as a reference orientation in the presently preferred embodiment. However, it will be understood that encoder component 60 could conceivably be the component that moves with walking beam 18.

In a preferred embodiment, light emitters 68 and 70 are used with corresponding light detectors 72 and 74 to produce two electrical signals as the light from light emitters 68 and 70 is passed/prevented by slots 64 in encoder component 60. Light emitters 68 and 70 and light detectors 72 and 74 may be light emitting diodes and corresponding photo detectors which are electronic components of low cost and wide availability with known circuitry for operation such as power supplies 76 and other related components.

Light elements 68–72 are preferably rigidly affixed to housing 62 which is preferably affixed to walking beam 18 such that housing 62 pivots exactly with walking beam 18.

The exact position of light elements 68–72 is not important but the relative spacing between the light elements is important for operation in the desired mode. For this operation, light elements 68–72 do not have the same spacing as that of slots 64. For instance, if slots 64 are spaced with one degree between them, light emitter/light detector combination 68,72 would be spaced N degrees plus some fraction of one degree from light emitter/light detector combination 70, 74. As an example for the case where slots 64 have a one degree spacing, light emitter/light detector 68,72 might be spaced by ten degrees plus one-quarter degree or ten and one-quarter degrees from light emitter/light detector 70, 74. Thus, as encoder component 60 pivots with respect to light elements 68–72, two distinct electrical signals are produced at 78 and 80 and fed to micro-controller circuit board or boards 82. Micro-controller board 82 may have a micro-controller, processor, or computer, and the various associated power supplies, buffers, memory and so forth for running a desired program or accomplishing the desired tasks as discussed herein. A convenient preferred differential spacing includes one quarter of the encoder slot spacing as might be termed a "quadrature" spacing. However, it will be understood that other differential spacings could be used as discussed above so long as two distinct out of phase signals are produced that can be used to determine not only relative movement but also relative direction of the movement between encoder wheel 60 and light elements 68–72 in the manner discussed subsequently.

Given the above description whereby each light detector 72, 74 produces a different signal for the reasons of spacing as discussed above, and given that each light detector is designed to produce either an on or off signal, characterized as a 1 or a 0, then it will be understood that there are 2 or four possible combinations of the signals or states. Moreover, the four signals occur in a specific sequence that depends on the direction of pivotal movement of relative motion between light detectors 72,74 and encoder component 60 or, more specifically, with the direction of pivotal movement of walking beam 18. Table 1 describes the movement in terms of these signals and shows the unique sequence for the two different directions of movement. Assuming the slots are at one degree intervals, the four states would occur each degree of pivotal movement thereby giving rise to accuracy within a one-quarter degree increment.

TABLE 1

| | Detector 72 | Detector 74 |
|---|---|---|
| Increments of Forward Movement | | |
| 0 | 0 | 0 |
| 1 | 1 | 0 |
| 2 | 1 | 1 |
| 3 | 0 | 1 |
| Increments of Reverse Movement | | |
| 0 | 0 | 0 |
| 3 | 0 | 1 |
| 2 | 1 | 1 |
| 1 | 1 | 0 |

The above inputs form a sequence that would be seen by micro-controller board 82 as repeating each four increments, which in the present example would be every degree. Whenever the sequence changes, the processor on micro-controller board 82 would know that a potential change in direction of walking beam 18 has occurred. Thus, there is no need to position micro-controller 42 in a precise relationship and it automatically calibrates itself regardless of the orientation. In a preferred embodiment, calibration effectively occurs every pumping cycle so that the typical calibration types of errors are reduced or eliminated.

It has been discovered that mechanical jitter from vibration and the like may be picked up due to the sensitivity of this device and may cause very short momentary reversals and therefore might be interpreted as changes of direction if not for programming intended to correct such problems. Such jitter typically occurs for only a few intervals before the actual direction of pivotal movement reasserts itself. Several methods exist for filtering out actual changes in direction from temporary changes in direction. In one method, microprocessor board 82 detects the sequence change and initially assumes a change in direction has occurred. At this point, which may be the beginning of the up-stroke or down-stroke, the micro-processor begins sampling data such as the electrical loading signal from strain gauge 36 as discussed in more detail below just as if the apparent reversal is an actual signal. The data is temporarily stored however, to verify that a change in sequence has occurred. If the sequence remains constant for a selected number of intervals, e.g., seven intervals, then the computer assumes the change in sequence is real and outputs the sampled data for transmission.

Another method for filtering out mechanical jitters and vibrations may be used after the top and bottom stroke pattern have already been established. The computer will look for a window wherein it is anticipated that the next reversal will occur. Generally, only a small time difference, if any, occurs in the time duration of consecutive pumping cycles. Thus, mechanical jitters that occur between cycles may be largely filtered out once a pattern is established. In another method, the micro-processor could be programmed to wait until a certain number of increments has occurred in an opposite pivotal direction before beginning to sample. So long as the amount of delay stays constant from cycle to cycle, the history of change of the dynamometer cards will still be quite visible and the detection of changes over time is in many cases the intended use of the dynamometer card. In another method, micro-processor 42 determines a rate of change of increments so that jitters and mechanical vibration that occur at a rate of change significantly different are subject to filtering. In another embodiment, a general photo element may be used with a relatively wide slot to detect a window wherein it is anticipated that a change in direction may occur.

As discussed above, any mechanical sticking of encoder component 60 itself may be reduced by increasing the bias force and/or increasing the inertia of encoder component 60. This may be accomplished with additional weights, reshaping to an elongate element, improving the bearings, increasing the mass of the encoder component, and other means, so that the disclosed presently preferred configuration is not considered to be at all limiting of these aspects. In another method, some means may be provided to detect mechanical motion orthogonal to the first and second pivotal directions thus indicating mechanical problems with pumpjack 10.

Thus, even with the highly sensitive readings derived from the present invention that is capable of detecting small mechanical jitters and vibrations, it is possible to obtain highly consistent data gatherings. As discussed above, consistency of the calibrations and readings over time is often the most important aspect of the dynamometer cards when looking for changes in the well over a time period is important. The elimination of slowly changing errors and calibration errors results in an improved product in an area where consistency is desired.

The dynamometer readout of the present invention also includes an improved data sampling technique that is preferably used with the highly accurate, automatically calibrated position detector described above but could be used with other position detectors such as mercury switches and the like.

At the beginning of a pumping cycle, which can arbitrarily be defined as either the top or bottom of the stroke depending on what is most convenient, micro-controller 42 times, preferably at least to the millisecond, the elapsed time duration of the cycle up to the beginning of the subsequent cycle. This time duration is used to predict what the next or subsequent pumping cycle elapsed time will be although in practice the actual time of the next pumping cycle may vary slightly. The predicted time duration is used with the number of samples, which the processor will attempt to take in order to calculate the rate at which samples will be taken. For instance, it might be desirable to take 360 samples, as this number would correspond to each degree increment of the pumping cycle. Knowing the predicted time interval for the cycle, and the number of samples, micro-controller 42 is programmed to calculate the sampling rate. The sampling rate could be constant throughout the pumping cycle. However, it may be preferable to use a dual modulus counting rate where one sampling rate is used for the down-stroke and another is used for the up-stroke to get the effect of fairly evenly spaced data samples throughout the stroke interval. A table could be used for this purpose as well. In fact, a table could optionally be placed in micro-controller 42 memory for the geometry of the pumping unit to create data sample spacing which is either evenly divided or which is intentionally not evenly divided throughout the stroke interval. The intentionally unevenly divided sampling rate, with respect to the stroke interval, could be used to sample more heavily during certain critical parts of the dynamometer card so that differences in the dynamometer cards over time is more readily apparent.

It will be understood that the sampling rate is preferably recalculated for each pump stroke to maintain accuracy. Therefore, the time duration of a first pumping cycle would be used to calculate the sampling rate for a second pumping cycle. The time duration of the second pumping cycle would be used to calculate the sampling rate of a third pumping cycles and so forth. It may be that if the next pump stroke ends earlier than expected a small number of samples may be left off. On the other hand, if the stroke ends later than expected a small pause may occur. However, due to the large number of samples being taken, this difference will be negligible and could be made less negligible by taking more samples. Probably somewhere in the range of 300 to 700 samples would provide highly detailed information. This format produces a low cost and consistent method of producing a dynamometer card that may be more suitable for use than more complex sampling techniques and devices. Time difference information between strokes as well as the time duration of each stroke may also supply useful information about a pump off condition and be sent along with other data.

Of course, if desired, the sampling rate could be controlled from the pump cycle position detector discussed above wherein each degree or half degree or so forth of the pumping cycle, as determined from relative movement with respect to encoder component 60 could be used to precisely pinpoint the angle of the sample of the pumping cycle with respect to the load. For instance, each second or fourth state in the sequence of increments as discussed earlier could be used to signal another load sample to be taken. Samples that were missed or the like could be handled as discussed below in dealing with the format of the data transmission and device for data transmission in accord with the dynamometer readout of the present invention.

Figure 4:
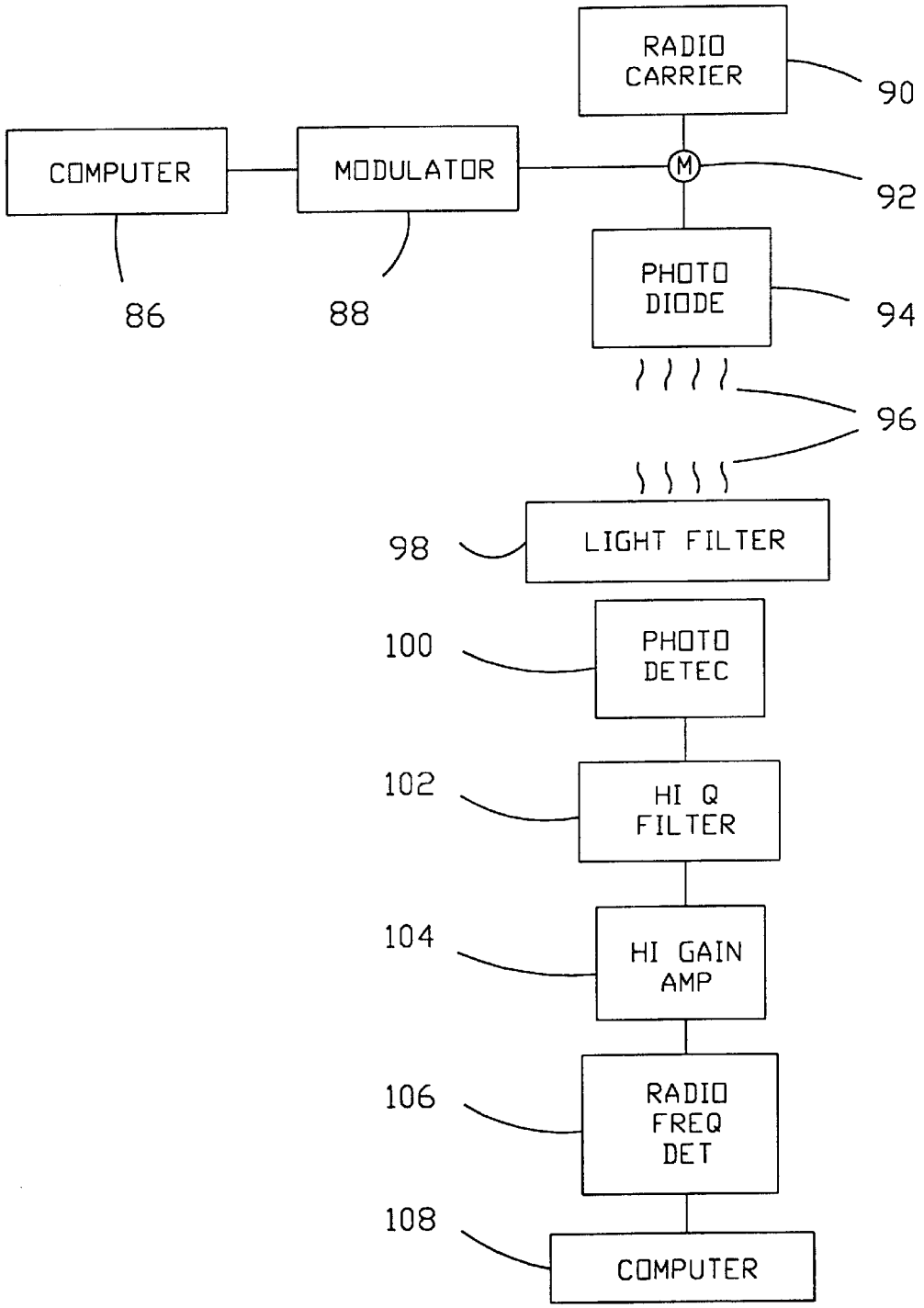
FIG. 4 is a block diagram of a light transmission and receiving system for sending dynamometer card information in accord with the present invention.
Figure 5:
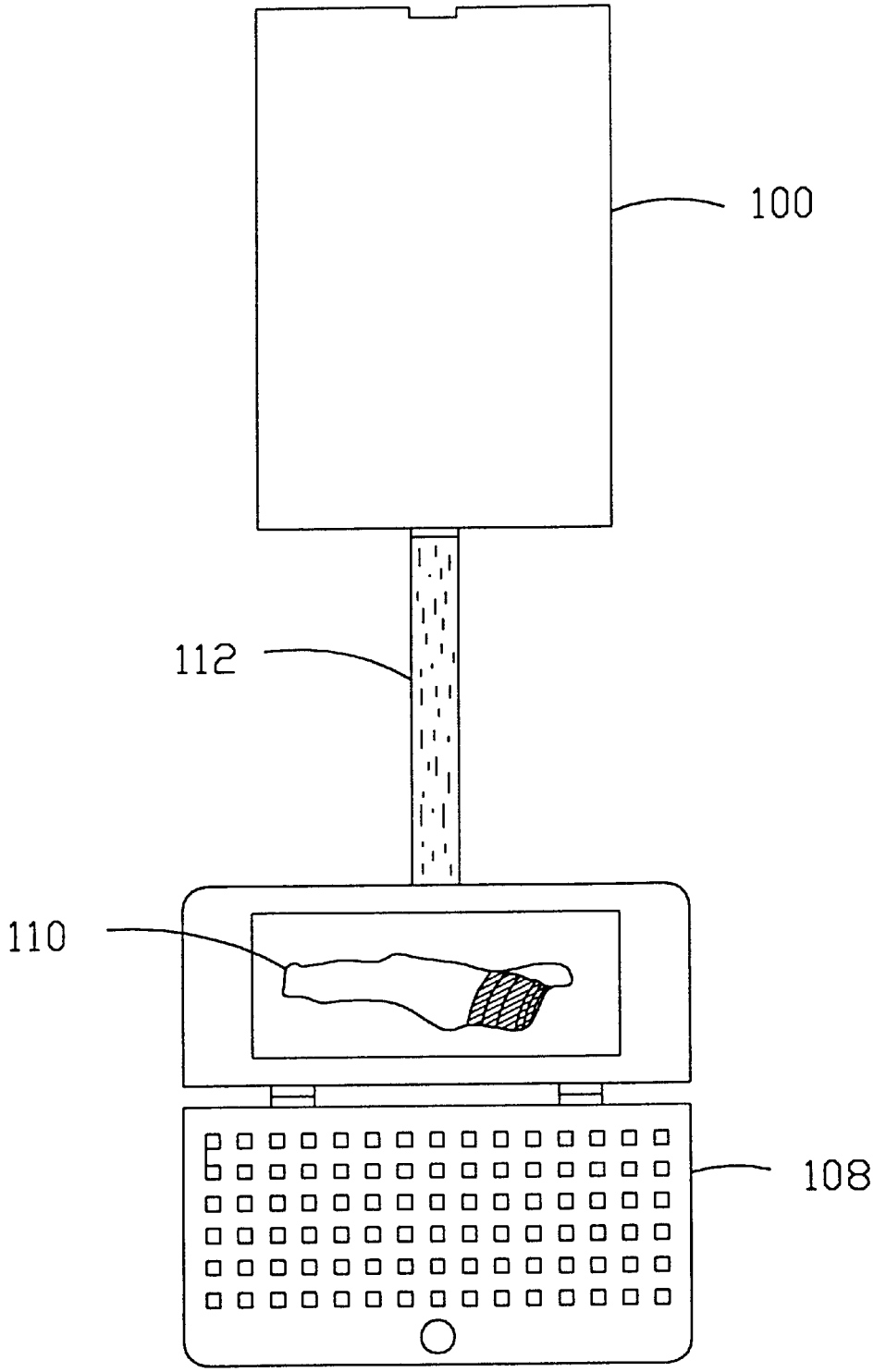
FIG. 5 is an elevational view of a suitable transceiver for receiving dynamometer card information in accord with the present invention.

Referring to FIG. 4 and FIG. 5, the basic components of an infrared transceiver in accord with the present invention. The preferred embodiment of this aspect of the dynamometer readout in accord with the present invention uses relatively inexpensive radio components that are already widely used in combination with an infrared transceiver. While only a transmitter/receiver is shown in FIG. 4, it will be understood that two sets of the transmitter/receiver of FIG. 4 are used that are substantially the same so that computer 108 of FIG. 5 and micro-controller 42 can send and receive. Experiments with infrared data association (IRDA) devices have shown they do not have the range or sufficient immunity to high ambient light levels, such as bright sunlight, or other interfering infrared sources. To overcome this problem, as discussed below, instead of switching the infrared on and off directly, a carrier frequency is used where the infrared diode is switched at a radio carrier frequency, and the photodetector signal at the receiving end is preferably filtered with a high Q narrow band circuit and amplified to a high level. To further improve the range, sensitivity, and selectivity, a radio receiver on a chip is incorporated into the infrared receiver, which interfaces to a portable computer.

Computer 86 of FIG. 4 may be a microprocessor, processor, controller or the like preferably mounted on micro-controller board 82 of micro-controller 42. Cable 44 is used to supply a signal to infrared transmitter 50 that preferably also includes a light detector such as a photosensitive diode. Thus, computer 86 samples the electrical load signal produced by strain gauge 36 and produces a sampled data signal. That signal is preferably applied to modulator 88, which may be in housing 62 of micro-controller 42 or may be in the housing of transceiver 46 which is mounted in a fixed relatively rigid position on frame 34. Modulator 88 operates with mixer 92 to modulate radio frequency carrier oscillator signal 90. The modulated signal is applied to photo diode 94 that is part of infrared transmitter 50 of FIG. 1. The modulated light signal 96 is produced and is transmitted through light filter 98 placed on receiver 100 shown in FIG. 5. The light filter filters out all ambient light except that at the desired wavelength to remove noise. Photodetector 100 receives the modulated light signal. Preferably, high Q narrow passband filter 102 is used to further filter the signal to reduce noise. The filtered signal is applied to high gain amplifier 104 and then applied to a readily available, low cost, radio frequency detector 106 from which is extracted the sampled data. The sampled data may then be applied to computer 108 through cable 112. Computer 108 may then be used to analyze the dynamometer data and produce a dynamometer card or a longer term comparison of several cards as indicated at computer screen 110.

The above-described device preferably uses proven techniques of single or double conversion superheterodyne circuitry adapted from ordinary radio devices and available at low costs. Radio receiver detectors may be of the type that use frequency shift keying of the modulated infrared carrier but could also use amplitude shift keying. At this time, carrier frequencies in and near the AM broadcast band are used. No RF is radiated so there is no problem with radio communication interference. RF leakage is well below FCC Part 15 limits. The circuit is preferably designed to be insensitive to radiated or conducted RFI. However, almost any carrier frequency that is within the turn on and turn off times of the infrared diode and detector should be quite effective. The infrared diodes and detectors should be as powerful as possible and transmit a light wavelength that will preferably travel easily through a car window for drive by data recording.

By incorporating the ability to tune the carrier via regular radio techniques such as phase locked loops or direct digital synthesis, another unique capability of this device is the ability for more than one device to operate in close proximity with other similar devices and to select at the receiving end which unit is to be monitored such as one selects which radio station to listen to. Thus, closely located wells may use different radio carrier frequencies as desired. At frequencies below about 10 MHZ, ordinary microprocessor grade crystals should provide sufficient accuracy to have the received signal fall within the desired passband.

A range of from 10 meters to 30 meters may typically be anticipated. To keep cost low, it is presently preferred to limit data rates to the audio spectrum, that is about 10 to 20 KHz at the upper end, primarily because ordinary consumer radio components may then be used for demodulation of data. However, since channel bandwidth is not limited to radio spectrum allocations, higher data rates than 20 KHz may be utilized. A speed of 9600 baud should be fast enough to get the data out without a buffer overrun in actual use. It is anticipated that with ASIC chip design, a fully integrated transceiver, transmitter, or receiver module could be easily designed for applications far beyond the dynamometer readout use outlined here.

During transmission of the signal, it is preferable that the beginning of each new set of data be indicated or announced with an index word. As an example, each time an index word is transmitted, the receiving computer would then expect to receive 360 data words assuming 360 samples of the load signal were to be transmitted. With a receipt of the next index word, the receiving computer would assume it has received all data for the previous dynamometer card and would expect data for a subsequent dynamometer card.

Data is preferably sent at a rate fast enough so that all words, such as 360 words, may be sent through the communications channel for receipt by computer 108 in about one-half the time required for the fastest known pumping units to complete a full pumping cycle. The data is spaced out with nulls or other data separator indicators, or an idle channel to fill in the gaps for the slower moving units. In this way, the data rate for each transmitter can be fixed, and the same micro-controller 42, transceiver 46, and software may be mass produced for a wide variety of pumping units without having to tweak the transmission speed components.

The index word is preferably repeated at the beginning of each new stroke (or dynamometer card) that is transmitted. This technique and a null or other signal between data samples provides a means to deal with the occasional missed data due to interference, marginal infrared signal, etc. In this way, cards corrupted by missing data may be quickly re-drawn and bad cards either discarded or interpolated in software. It is anticipated that with correction codes, errors may be further reduced and may even be correctable.

Thus, the dynamometer readout of the present invention provides for an improved device that, in one preferred embodiment, uses an encoder wheel and appropriate software for automatic calibration and continuous re-calibration. In this way, cards produced over time may be used to make meaningful comparisons. Data is sampled by a unique low cost method that does not require exact correlation signals to be produced during the pump cycle associated with the loading signal utilizing transducers that in the past have been associated with wear. Moreover, an infrared transceiver may be used in another preferred embodiment of the present invention to allow drive by downloading of stand alone pump off controls and other devices in an outdoor environment where it would be inconvenient to physically get out of the vehicle and connect a cable to the unit. It would be an excellent technique for hazardous environments or those where costly regulations would be encountered in making a physical connection.

Figure 6:
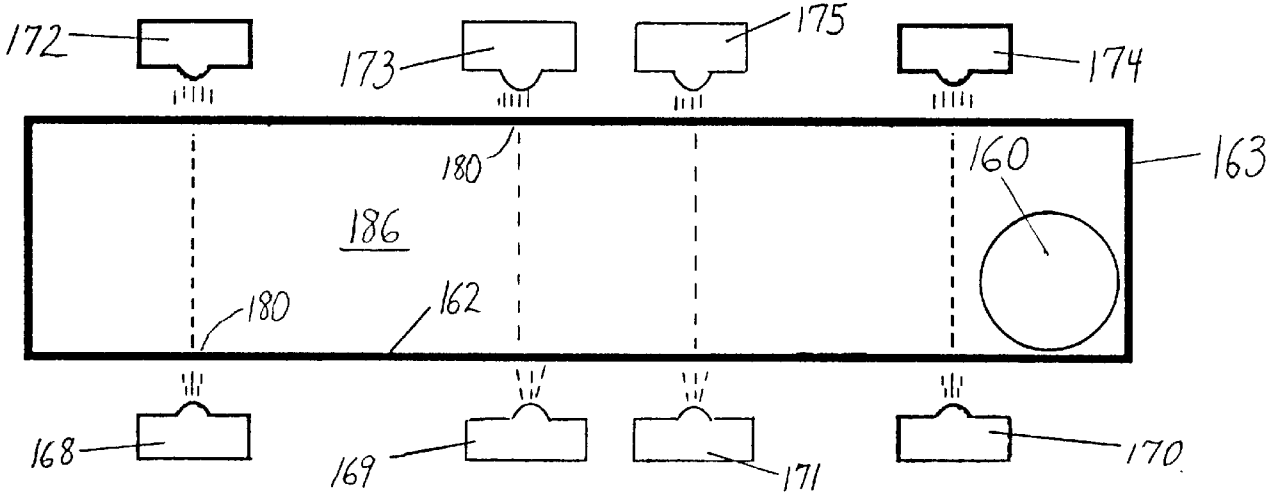
FIG. 6 is a diagrammatical view of a dynamometer readout apparatus including a solid sphere moveably disposed within a sensor body.
Figure 7:
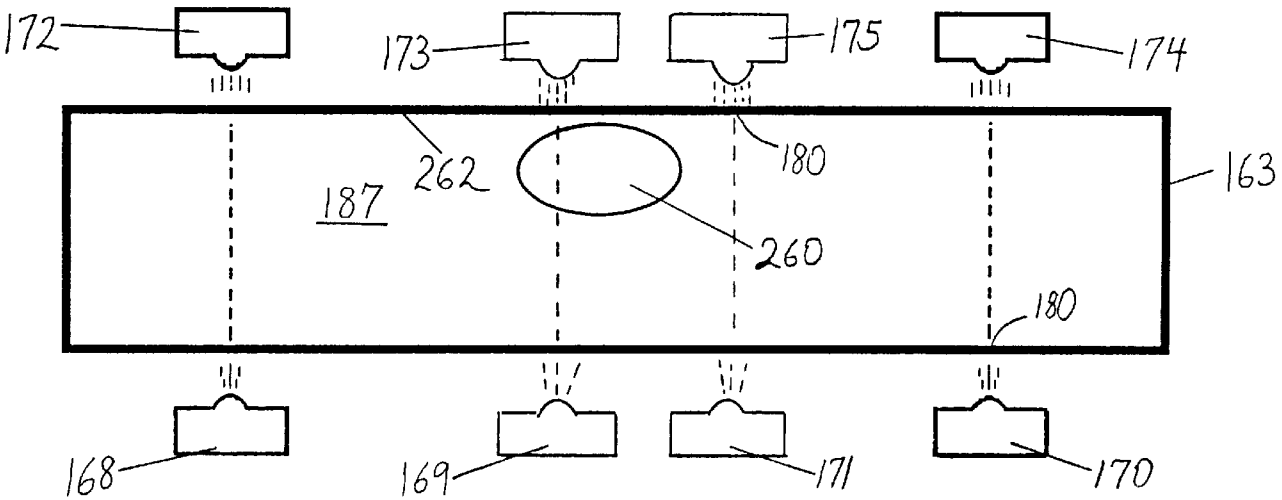
FIG. 7 is a diagrammatical view of a dynamometer readout apparatus including a fluid bubble moveably disposed within a sensor body.

In embodiments, such as illustrated in FIGS. 6 and 7, a dynamometer readout for a pumpjack may include a microcomputer 86 and/or processor 42 which includes or is connected to a pivotal position sensor 163 secured to the walking beam and having one or more apertures 180 in the sensor 163 capable of transmitting light to the sensor 163. The sensor 163 may be connected to the processor 42 or 86, electrically, optically or by radio. A light interrupter 160 or 260 may be included within the pivotal position sensor 163, with the light interrupter 160 or 260 being moveably responsive to changes in the inclination of the walking beam. The sensor may include an uninterrupted surface 162 or 262, along which the light interrupter, 160 or 260, may freely move. The uninterrupted surface may include a floor, such as may be found in a round cross-sectioned tube or housing, or a substantially surface such as may be found in a quadratic cross-sectioned tube or housing.

In an embodiment as illustrated in FIG. 6, the light interrupter 160 may be a solid object 160, such as a ball, a cylinder, or a disk, moveably positioned within the sensor 163. Sensor 163 may be filled with a liquid or a gas as desired, depending upon obtaining a desired degree of attenuation of interrupter velocity and/or acceleration. The sensor 163 may include a substantially smooth, uninterrupted surface 162 along which the light interrupter 160 may freely move in response to changes in walking beam inclination. The solid object light interrupter 160 may move along the substantially smooth, uninterrupted surface, such as by rolling or sliding within the chamber. The term uninterrupted surface, as used herein may be defined to broadly encompass a tube, chamber, housing, or substantially planar surface, which may substantially encase, contain, or support the light interrupter. For example, the uninterrupted surface may include a tube having a substantially circular, rectangular or square cross-section.

In an embodiment as illustrated in FIG. 7, the light interrupter 260 may be a bubble of a first fluid, such as air, positioned within a chamber 163 including a second fluid, such as a clear liquid, therein. Light may be refracted or interrupted at the gas-liquid interface. The chamber 163 may include a substantially smooth, uninterrupted surface 262 along which the bubble type light interrupter may move in response to changes in walking beam inclination. The bubble may also be a solid object, which floats or may be otherwise suspended within a fluid. The fluid may be a fluid resistive to freezing. The uninterrupted surface, as defined previously, may also include a substantially clear tube, such as may be commonly found in a carpenters level. The tube may be substantially straight or may include a slight arc or curvature, along the length of the tube.

In embodiments such as illustrated in FIGS. 6 and 7, the first 168 and second 170 light emitters with corresponding first 172 and second 174 light detectors, respectively, each emitter may be aligned on a side of the sensor 163 opposite the respective emitter. Each of a plurality of emitters may be on the same side of the sensor, and each of a plurality of detectors may be on the opposing side of the sensor. The first 168 and second 170 light emitters and the corresponding first 172 and second 174 light detectors may be secured to the walking beam for angular movement in the first and second pivotal directions. The first pivotal position may be a clockwise pivotal direction, and the second pivotal direction may be a counter-clockwise pivotal direction of the walking beam. The first 168 and second 170 light emitters and the corresponding first 172 and second 174 light detectors may be mounted adjacent the sensor 163, with a spacing along the length of the walking beam, between the first light emitter 168 and the second light emitter 170. Thereby, a first or clockwise sequence of signals corresponding to first and second time periods when the walking beam is at first and second pivotal positions, respectively, during movement of the walking beam in the clockwise pivotal direction. A second or counterclockwise sequence of signals may be produced for movement of the walking beam in the second pivotal direction as the light emitter interrupts each of the emitted light beams. The counterclockwise sequence of signals may include third and fourth signals corresponding to when the walking beam is at a third or fourth pivotal position during counterclockwise walking beam movement. The third and fourth signals may occur at substantially the same pivotal position as the first and second signals. It will be understood by those skilled in the art, however, that due to differences or variations in walking beam velocity, acceleration and pumping unit structural geometry, movement of the light interrupter may be different during the clockwise pivotal movement of the walking beam than during the counterclockwise walking beam movement, such that the third and fourth signals may occur at pivotal positions different from the first and second signals.

A load sensor may be secured to the walking beam or otherwise on the pumping unit, such as near the polished rod 14, to sense varying load forces during various walking beam pivotal position points in the pumping cycle. The load sensor may produce an electrical load signal representative of pumping forces, that may be sampled during each pumping cycle as a function of walking beam position and/or pumping cycle rate.

A computer/processor may be provided and connected, such as electrically or optically, to each of the first and second light detectors to receive and process the clockwise sequence of signals and the counterclockwise sequence of signals from the detectors 172 and 174. The processor may analyze the clockwise sequence of signals and the counterclockwise sequence of signals to detect or determine a change in direction from the first pivotal direction of the walking beam to the second pivotal direction. The processor 82 may use the determined change in direction to control initiation of sampling of the electrical load signal, and the sampling rate.

As illustrated in FIG. 7, the light interrupter 260 may include a bubble, such as a gas or liquid bubble, in a fluid filled portion of the pivotal position sensor 163. The bubble 260 may act to distort, refract or otherwise interfere with the light passing between a light emitter and a light detector. A sequence of signals representative of the position of the bubble 260 within the sensor 163 at various points in time may be generated by the light detectors, facilitating determination by the processor of angular position of the walking beam at each signal point. Thereby, additional processing by the processor may be performed to provide pump-off control of the pumping unit.

Other embodiments may include a plurality of emitters and detectors. For example, third 169 and fourth 171 light emitters with corresponding third 173 and fourth 175 light detectors respectively aligned on opposing sides of the pivotal position sensor 163, may be provided. The third 169 and fourth 171 light emitters may be positioned between the first 168 and second 170 light emitters. The corresponding third 173 and fourth 175 light detectors may be positioned between the first 172 and second 174 light detectors.

The light emitters 168, 169, 170, 171 and the light detectors 172, 173, 174, 175, in conjunction with the light interrupter, 160 or 260, may permit generation of a sequence of at least four sets of signals for in each of the clockwise and the counterclockwise pivotal directions. Two additional signals corresponding to walking beam position may be generated during clockwise walking beam movement, such as a fifth and sixth signals. Two additional signals corresponding to walking beam position may be generated during counterclockwise pivotal beam movement, such as seventh and eighth signals. The signals may facilitate refined sensing of pumping unit load conditions and determining changes in walking beam velocity between successive pumping cycles, particularly as pumping conditions change.

As discussed above in reference to quadrature spacings, it may be understood that differential spacings could be used between detectors and between emitters, in conjunction with specific sizes of light interrupter bubbles 260 or solid objects 160, so as to facilitate generation of at least two distinct out of phase signals during each signal sequence. Thereby, the processor may determine a pivotal direction of movement and may also sense rate or velocity variations within each pumping cycle. It will also be understood by those skilled in the relevant art that still other embodiments may be provided with additional emitter/detector pairs to further refine sensitivity.

A method of providing a pumpjack dynamometer readout may include securing to the walking beam a pivotal position sensor 163 including a light interrupter 160 or 260 movably disposed within the pivotal position sensor. A light may be directed from a plurality of light emitters 168, 169, 170, 171 through an aperture 180 in the pivotal position sensor 163. The light from the plurality of light emitters may be received through the aperture 180 by a respective, corresponding plurality of light detectors 172, 173, 174, 175 to thereby produce a sequence of signals. The plurality of light emitters and the corresponding plurality of light detectors may be mounted to the walking beam to be moveable with the pivotal position sensor 163 as the walking beam moves in each of the first and second pivotal directions.

The plurality of light emitters and the plurality of corresponding light detectors may be positioned to provide at least a first or clockwise sequence of electrical signals when the walking beam moves in the first or clockwise pivotal direction, and at least a second or counterclockwise sequence of electrical signals when the walking beam moves in the second or counterclockwise pivotal direction. A load cell or load transducer may be included on the pumpjack to provide a variable electrical load signal during the pumping cycle corresponding to the variable load on the walking beam during the pumping cycle. The load signal during at least one pumping cycle may be sampled by the processor. Sample timing may be at least partially based on a determined or measured pumping cycle rate or change from the clockwise sequence of signals to the counterclockwise sequence of signals that occurs during each pumping cycle when the walking beam changes from the clockwise pivotal direction to the counterclockwise pivotal direction.

Light received by a detector 172, 173, 174, 175 may be interrupted, such as by refraction or blockage, with a light interrupter movably disposed within the pivotal position sensor. The interrupter 160 or 260 may move within the sensor 163 in response to changing pivotal direction of the walking beam. Light interrupter movement may be such as by rolling, sliding, gliding, or as in the case of a bubble, by displacement.

The foregoing disclosure and description of the invention is illustrative and explanatory thereof, and it will be appreciated by those skilled in the art, that numerous changes, e.g., additional photo detectors/emitters, only some of which have been mentioned hereinabove, in the types, arrangement, order of operation as well as in the various details of the illustrated construction or combinations of features of the various dynamometer readout elements may be made without departing from the spirit of the invention.

What is claimed is:

1. A dynamometer readout apparatus for a pumpjack with a walking beam, said walking beam being pivotally moveable in a first pivotal direction and in an opposite second pivotal direction, said walking beam changing pivotal direction twice during each pumping cycle for pumping a well, said apparatus comprising:

an encoder component pivotally secured to said walking beam, said encoder component having a plurality of spaced apart slots disposed therein, said encoder being biased to remain at a reference orientation relative to said walking beam;

first and second light emitters with corresponding first and second light detectors respectively aligned on opposing sides of said encoder component, said first and second light emitters and corresponding first and second light detectors being fixed to said walking beam for angular movement in said first and second pivotal directions with respect to said reference orientation of said encoder component, said first and second light emitters and corresponding first and second light detectors being mounted with a spacing different than said spaced apart slots of said encoder component to thereby produce a first sequence of signals for movement of said walking beam in said first pivotal direction and a second sequence of signals for movement of said walking beam in said second pivotal direction;

a load sensor mounted to detect loading corresponding to said pumping cycle for producing an electrical load signal; and a processor electrically connected to said first and second light detectors to receive said first sequence of signals and said second sequence of signals, said processor analyzing said first sequence of signals and said second sequence of signals to detect a change in direction from said first pivotal direction of said walking beam to said second pivotal direction of said walking beam, said processor using said change in direction to control initiation of sampling of said electrical load signal.

2. The dynamometer readout of claim 1, wherein said processor distinguishes a mechanical jitter that produces a temporary change from said first sequence of signals to said second sequence of signals.

3. The dynamometer readout of claim 1, further comprising:

said processor obtaining a first time duration for a first pumping cycle, said processor obtaining a predetermined number of samples, said processor using said first time duration and said predetermined number of samples to determine a sample rate for sampling said electrical load signal during a second pumping cycle subsequent to said first pumping cycle.

4. The dynamometer readout of claim 1, further comprising:

said processor selectively providing a sampling rate that varies during each pumping cycle.

5. The dynamometer readout of claim 1, further comprising:

a light emitting transmitter, said processor outputting data at a constant rate using a data format with an index word for beginning each new dynamometer card.

6. The dynamometer readout of claim 1, further comprising:

a radio frequency carrier generator, a radio modulator receiving said sampling from said processor and modulating said radio frequency carrier generator to produce a modulated radio frequency carrier signal, and a light emitting element to produce a light signal in response to said modulated radio frequency carrier signal.

7. A method for providing a pumpjack dynamometer readout, said pumpjack having a walking beam, said walking beam being pivotally moveable in a first pivotal direction and in an opposite second pivotal direction, said walking beam changing pivotal direction twice during each pumping cycle for pumping a well, said method comprising:

providing a load sensor to detect loading corresponding to each said pumping cycle for producing an electrical load signal;

producing a detection signal when said walking beam changes from said first pivotal direction to said opposite second pivotal direction during each said pumping cycle;

determining a first duration of a first pumping cycle from said detection signal;

selecting a designated number of samples of said electrical load signal;

determining a second cycle sample rate of said electrical load signal for a second pumping cycle based on said designated number of samples and said first duration of said first pumping cycle, said second pumping cycle being subsequent to said first pumping cycle; and sampling said electrical load signal for said second pumping cycle at said second cycle sampling rate.

8. The method of claim 7, further comprising:

determining a second time duration of the second pumping cycle from the detection signal, determining a third cycle sample rate based on the designated number of samples and the second time duration, and sampling the electrical load signal for the third pumping cycle at the third cycle sample rate.

9. The method of claim 7, further comprising:

providing that said second cycle sampling rate is constant throughout the second pumping cycle, and providing that the third cycle sampling rate is constant throughout the third pumping cycle, the second cycle sampling rate being changeable with respect to the third sampling rate.

10. The method of claim 7, further comprising:

providing that said second cycle sampling rate selectively varies during said second pumping cycle.

11. The method of claim 7, further comprising:

providing that said second cycle sampling rate varies during said second pumping cycle based on a table stored in a memory.

12. A dynamometer readout for a pumpjack with a walking beam, said walking beam being pivotally moveable along a beam length in a clockwise pivotal direction and in an opposite counterclockwise pivotal direction, the walking beam changing pivotal direction twice during each pumping cycle for pumping a well, the apparatus comprising:

a pivotal position sensor secured to the walking beam, the pivotal position sensor having apertures capable of transmitting light through the aperture, the pivotal position sensor including a chamber having an uninterrupted surface along a length of the walking beam and a light interrupter positioned within the chamber and moveably responsive to pivotal inclination of the walking beam;

first and second light emitters each mounted on a side of the pivotal position sensor with a spacing along a length of the walking beam between the first and second light emitters, the first and second light emitters each being fixed to the walking beam for angular movement in the clockwise and counterclockwise pivotal directions with the walking beam;

first and second light detectors each mounted on another side of the pivotal position sensor opposite a respective emitter with a spacing along a length of the walking beam between the first and second light detectors, the first and second light detectors each being fixed to the walking beam for angular movement in the clockwise and counterclockwise pivotal directions with the walking beam, the first and second light detectors for generating a clockwise sequence of signals corresponding to first and second time periods when the walking beam is at first and second pivotal positions, respectively, during movement of the walking beam in the clockwise pivotal direction and for generating a counterclockwise sequence of signals corresponding to third and fourth time periods when the walking beam is at third and fourth pivotal positions, respectively, during movement of the walking beam in the counterclockwise pivotal direction;

a load sensor to sense varying loads on the walking beam during the pumping cycle and producing a varying load signal representative of the sensed load; and a processor responsive to each of the clockwise sequence of signals, the counterclockwise sequence of signals, and the varying load signal to generate dynamometer signals representative of varying load as a function of pivotal position relationship of the walking beam.

13. The dynamometer readout apparatus as defined in claim 12, wherein the light interrupter further comprises:

a gas bubble in a liquid filled chamber in the pivotal position sensor.

14. The dynamometer readout apparatus as defined in claim 12, wherein the light interrupter further comprises:

a solid object in a chamber in the pivotal position sensor.

15. The dynamometer readout apparatus as defined in claim 14, wherein the solid object is a substantially spherical ball and the uninterrupted surface is a floor, the ball moveable along the floor.

16. The dynamometer readout apparatus as defined in claim 14, wherein the processor determines a change in pivotal walking beam direction and controls initiation of sampling of the varying load signal from the load sensor at lest partially based upon the change in pivotal direction.

17. The dynamometer readout apparatus as defined in claim 12, further comprising:

third and fourth light emitters each mounted on a side of the pivotal position sensor with a spacing along a length of the walking beam between the third and fourth light emitters, the third and fourth light emitters each being fixed to the walking beam for angular movement in the clockwise and counterclockwise pivotal directions with the walking beam; and third and fourth light detectors each mounted on another side of the pivotal position sensor opposite a respective emitter with a spacing along a length of the walking beam between the third and fourth light detectors, the third and fourth light detectors each being fixed to the walking beam for angular movement in the clockwise and counterclockwise pivotal directions with the walking beam, the third and fourth light detectors for generating a clockwise sequence of signals corresponding to first and second time periods when the walking beam is at fifth and sixth pivotal positions, respectively, during movement of the walking beam in the clockwise pivotal direction and for generating a counterclockwise sequence of signals corresponding to third and fourth time periods when the walking beam is at seventh and eighth pivotal positions, respectively, during movement of the walking beam in the counterclockwise pivotal direction.

18. The dynamometer readout apparatus as defined in claim 12, wherein each of the first and second light emitters are on a same first side of the sensor, and each of the first and second light detectors are on a same second side of the sensor, opposite the first side.

19. A method of providing a pumpjack dynamometer readout, the pumpjack having a walking beam, the walking beam being pivotally moveable in a clockwise pivotal direction and in an opposite counterclockwise pivotal direction, the walking beam changing pivotal direction twice during each pumping cycle for pumping a well, the method comprising:

securing a pivotal position sensor to the walking beam, the sensor including a light interrupter movably disposed within the pivotal position sensor;

directing light from a plurality of light emitters through apertures in the pivotal position sensor;

sensing the light from the plurality of light emitters through the apertures by a respective plurality of light detectors to generate a clockwise sequence of signals corresponding to a plurality of time periods when the walking beam is at a respective plurality of positions during movement in the clockwise pivotal direction, and to generate a counterclockwise sequence of signals corresponding to a plurality of time periods when the walking beam is at a respective plurality of positions during movement in the counterclockwise pivot direction;

interrupting the light received by a detector with a light interrupter movably disposed within the pivotal position sensor and movable in response to walking beam pivotal position; and sensing a load and producing an varying load signal representative of the load on the walking beam during the pumping cycle.

20. The method of providing a pumpjack dynamometer readout as defined in claim 19, further comprising:

sampling the sensed varying load signal by the processor during at least one pumping cycle with initiation of sampling and termination of sampling during the pumping cycle based on a determined change from the clockwise sequence of signals to the counterclockwise sequence of signals and a determined change from the counterclockwise sequence of signals to the clockwise sequence of signals.

21. The method of providing a pumpjack dynamometer readout as defined in claim 19, further comprising:

positioning a bubble in a liquid filled chamber in the pivotal position sensor as the light interrupter to provide the clockwise sequence of electrical signals when the walking beam moves in the clockwise pivotal direction and the counterclockwise sequence of signals when the walking beam moves in a counterclockwise pivotal direction.

22. The method of providing a pumpjack dynamometer readout as defined in claim 19, further comprising:

positioning a solid light interrupter in a chamber in the pivotal position sensor as the light interrupter to facilitate generation of the clockwise sequence of signals when the walking beam moves in the clockwise pivotal direction and to facilitate generation of the counterclockwise sequence of signals when the walking beam moves in a counterclockwise pivotal direction.

23. The method of providing a pumpjack dynamometer readout as defined in claim 22, wherein the solid light interrupter moves within the chamber by rolling along an uninterrupted surface.

* * * * *